US005992206A

United States Patent [19]

Kühne

[11] Patent Number: 5,992,206

[45] Date of Patent: Nov. 30, 1999

[54] CLINCHING DIE HAVING METALLIC RESTORING MEMBER

[75] Inventor: Timm Kühne, Bad Sachsa, Germany

[73] Assignee: Eckold GmbH & Co. KG, Germany

[21] Appl. No.: 08/946,890

[22] Filed: Oct. 8, 1997

[30] Foreign Application Priority Data

Oct. 9, 1996 [DE] Germany ..... 296 17 574 U
Oct. 18, 1996 [DE] Germany ..... 296 18 060 U

[51] Int. Cl.[6] ..... B21D 39/03

[52] U.S. Cl. ..... 72/395; 72/481.3; 29/21.1

[58] Field of Search ..... 72/395, 396, 465.1, 72/481.1, 481.3, 481.6, 481.7; 29/21.1, 798

[56] References Cited

U.S. PATENT DOCUMENTS 2,619,855 12/1952 Williams ..... 29/21.1
2,626,687 1/1953 Williams ..... 29/21.1
4,972,565 11/1990 Eckold et al. ..... 29/243.529
5,072,518 12/1991 Scott ..... 29/798
5,177,861 1/1993 Sawdon ..... 29/798
5,860,315 1/1999 Sawdon ..... 72/481.3

FOREIGN PATENT DOCUMENTS 0 523 473 12/1996 European Pat. Off. .
37 13 083 10/1987 Germany .

*Primary Examiner*—Daniel C. Crane
*Attorney, Agent, or Firm*—Townsend and Townsend and Crew LLP

[57] ABSTRACT

A tool set for clinch-connecting superposed sheet materials is disclosed, the tool set comprising a punch and a die. The die includes an anvil and shaping elements displaceably disposed on the anvil. All shaping elements are positioned by one single metallic member mounted on the die such that it is destroyed upon removal. Also, a novel socket for mounting the tool set on a press is disclosed.

47 Claims, 7 Drawing Sheets

Fig. 5
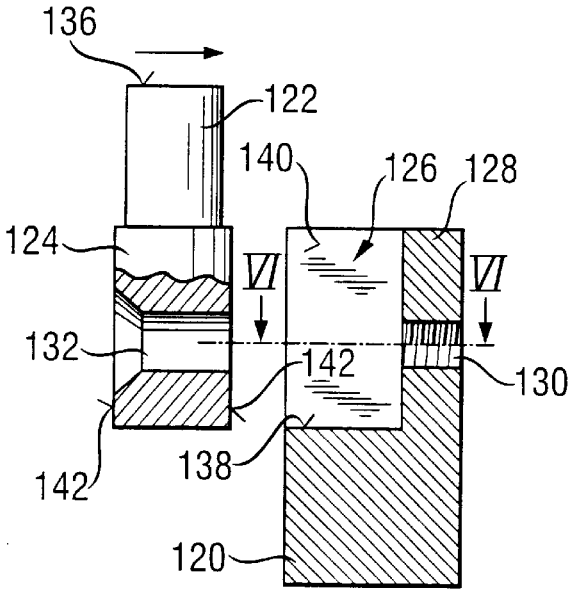
Fig. 7
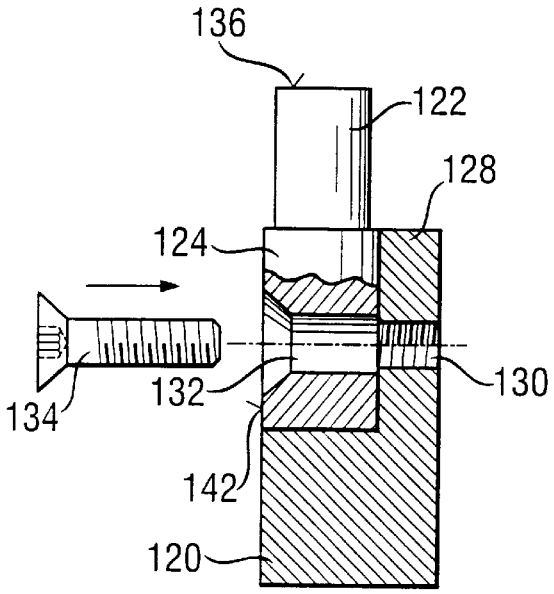
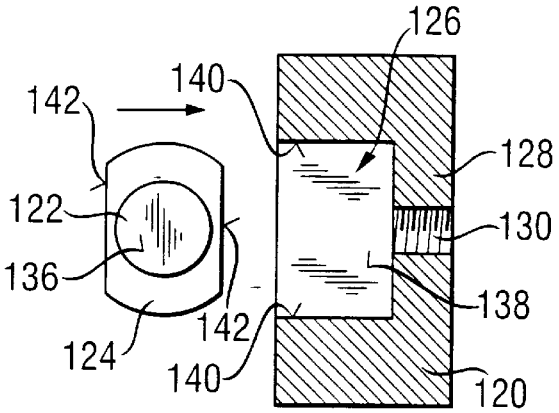
Fig. 6
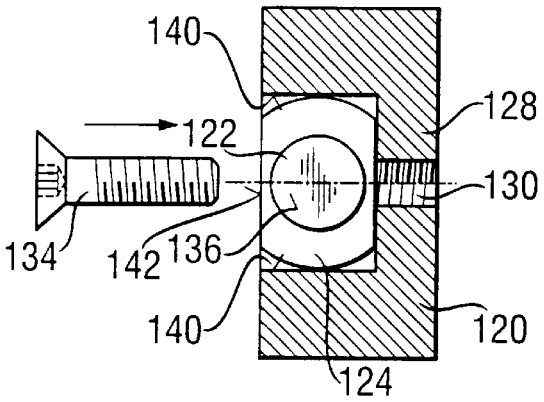
Fig. 8

Fig. 13
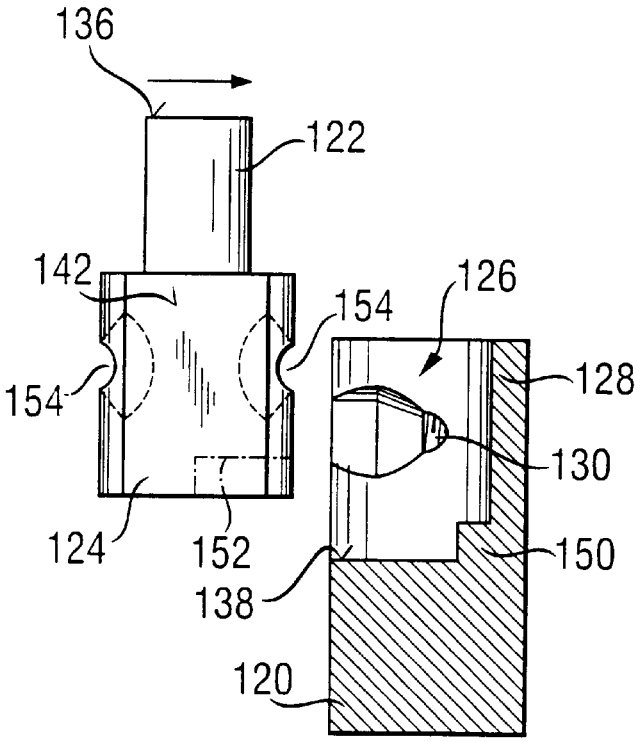
Fig. 15
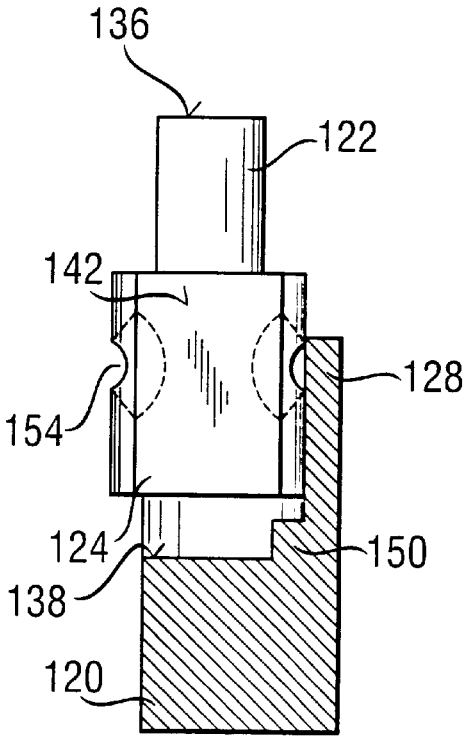
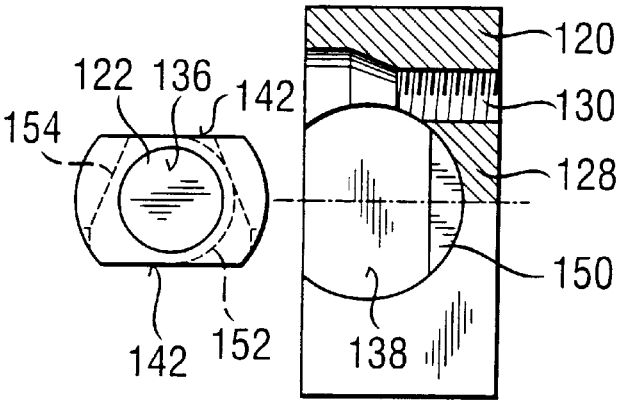
Fig. 14
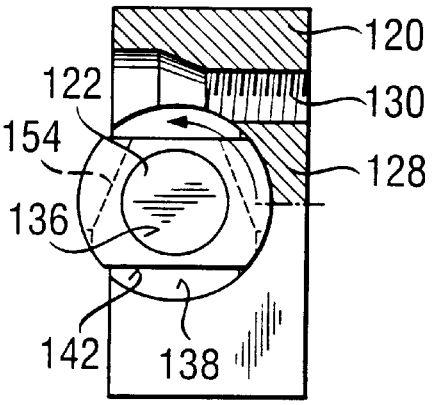
Fig. 16

Fig. 17
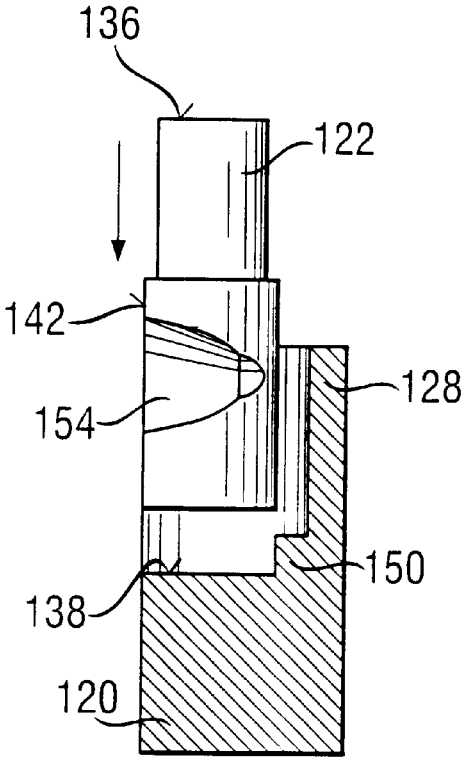
Fig. 19
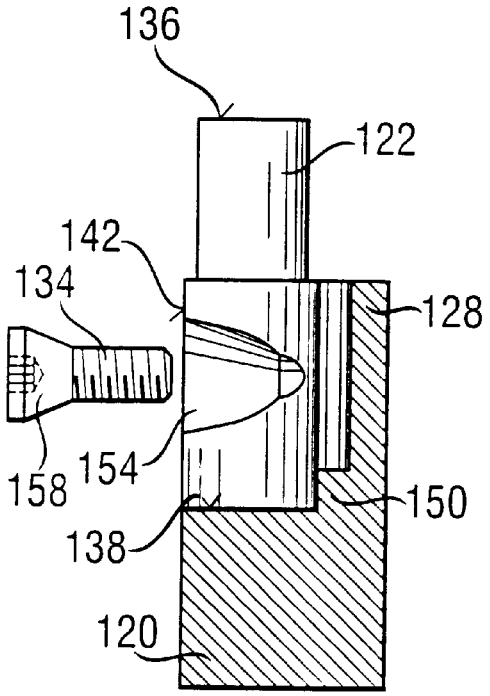
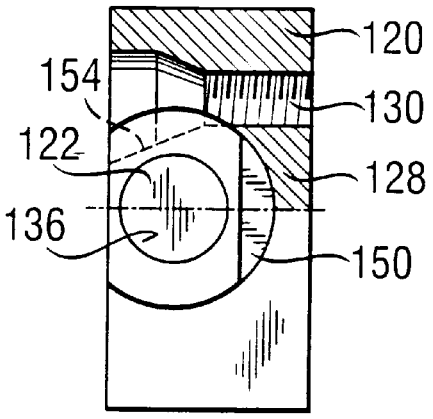
Fig. 18
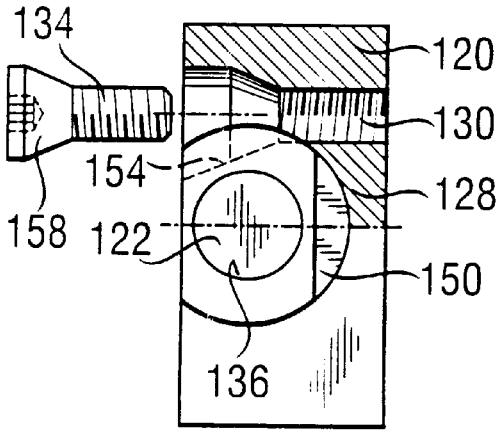
Fig. 20

CLINCHING DIE HAVING METALLIC RESTORING MEMBER

FIELD OF THE INVENTION

The present invention relates to a clinching die as a part of a tool set, the tool set also comprising a punch.

BACKGROUND OF THE INVENTION

Clinching of superposed sheet materials by means of cooperating punches and dies driven by a press is a wellknown technique. Briefly, a portion of the superposed sheets is displaced orthogonally with respect to a sheet plane by means of a punch penetrating into the sheet material which is supported by a die. The die comprises an anvil, the displaced material is compressed between anvil and punch. Thereby, the displaced material is squeezed and cold-flows laterally thereby forming the clinch connection. In order to permit lateral material flow, the die comprises shaping elements which are stationary during the displacement step but may laterally yield when the cold flux occurs. Elastic means are provided to restore the rest position of the shaping elements.

Restoration of the shaping elements may be performed in that the shaping elements are themselves elastically deformable. An example of this prior art is disclosed in United Kingdom Patent Application 2 069 394. There is a need for a compromise between sufficient strength of the shaping elements to resist forces acting on them during sheet material displacement and sufficient yielding motion for cold-flowing sheet material.

In another prior art design, restoring cushions or rings made of elastomeric material enclose the shaping elements. An example is illustrated in German Patent Application 37 13 083. Such material, however, is easily damaged due to contact with cutting edges and the like, and it may also be susceptible to chemical attack, e.g. of solvents.

Finally, clinching dies are known wherein the shaping members are rugged but are biased into their rest position and positioned by means of leaf springs; such leaf springs are rivetted or screwed on an anvil or a support member of the latter. Examples are disclosed in U.S. Pat. No. 4,972,565 or European Patent 523 473. A drawback is the complicated and time-consuming assemble of the die and, most importantly, that the die may be manipulated, e.g. by replacing the original shaping elements.

It is an object of the present invention to provide a clinching die free of the drawbacks mentioned above.

It is a further object of the invention to provide a clinching die without a trade-off between strength and yieldability.

It is a further object of the invention to provide such a die without elastomeric elements.

It is a further object of the invention to provide a clinching die which is destroyed upon manipulation.

A further object of the invention is a tool set including a die of the invention.

A further object of the invention is such a tool set specially adapted to complementary sockets mounted on a press.

SUMMARY OF THE INVENTION

A die according to the invention includes an anvil and at least two shaping elements supported by the anvil and displaceable relative thereto. A single metallic member performs several functions:

- it secures the shaping elements on the anvil,
- it urges the shaping elements towards one another into their rest position,
- it provides stop means for limiting the outward displacement of the shaping elements,
- it guides the shaping elements during their movement relative to the anvil, and
- it assures that the die will be destroyed upon an attempt to manipulate the die.

As mentioned above, the die of the invention is one part of a tool set including a punch adapted to cooperate with the die when moved relative to one another by means of a press. Both said parts, die and punch, have a shaft to be received in a cavity of a socket mounted on the press.

At present, there are two types of sockets in use. A first type has a hollow cylindrical cavity, and shafts complementary thereto are cylindrical. A second type of cavity is of a parallel-epipedic shape, and the complementary shafts are square shaped. The shafts are fixed in the cavities e.g. by means of screws.

The first type has the advantage of simple manufacturing techniques, as drilling, turning, round grinding. However, it has the drawback that such sockets need much space and, first of all, protrude in direction of work piece insertion. Further, tool exchange is possible only in axial direction which in turn requires frequently disassembly of strippers and the like. Thus, quick tool exchange is not possible.

Hollow square cavities and shafts complementary thereto have the advantage that the cavities is open at its front side so that a tool shaft may be removed to this side thereby permitting quick tool exchange. A drawback is that the manufacture is much more complicated than that of cylindrical items.

A common drawback of both said systems is their incompatibility with one another: Square shafts do not fit into cylindrical cavities, and vice versa.

To overcome the drawbacks mentioned above, the present invention provides for novel assembly means so as to mount punch and die in a press.

A preferred embodiment of the invention will now be described with reference to the accompanying drawings.

BRIEF DESCRIPTION OF THE DRAWINGS

FIG. 5 illustrates an axial section view of a socket and a tool shaft to be inserted therein, FIG. 6 shows socket and shaft along the section line 6—6 of FIG. 5, FIGS. 7 and 8 show in analog manner to FIGS. 5 and 6, respectively, the tool shaft in the socket prior to clamping, FIGS. 13 through 20 show in analog manner phases of a tool exchange operation with different types of shaft and socket, the odd numbered FIG. being axial partial section views and the even numbered FIG. being top view/section views.

DETAILED DESCRIPTION OF THE DRAWINGS

FIGS. 1 through 4 relate to the die of the invention, and FIG. 5 through 20 relate to the improved assembly system for such die and its punch.

Figure 1:
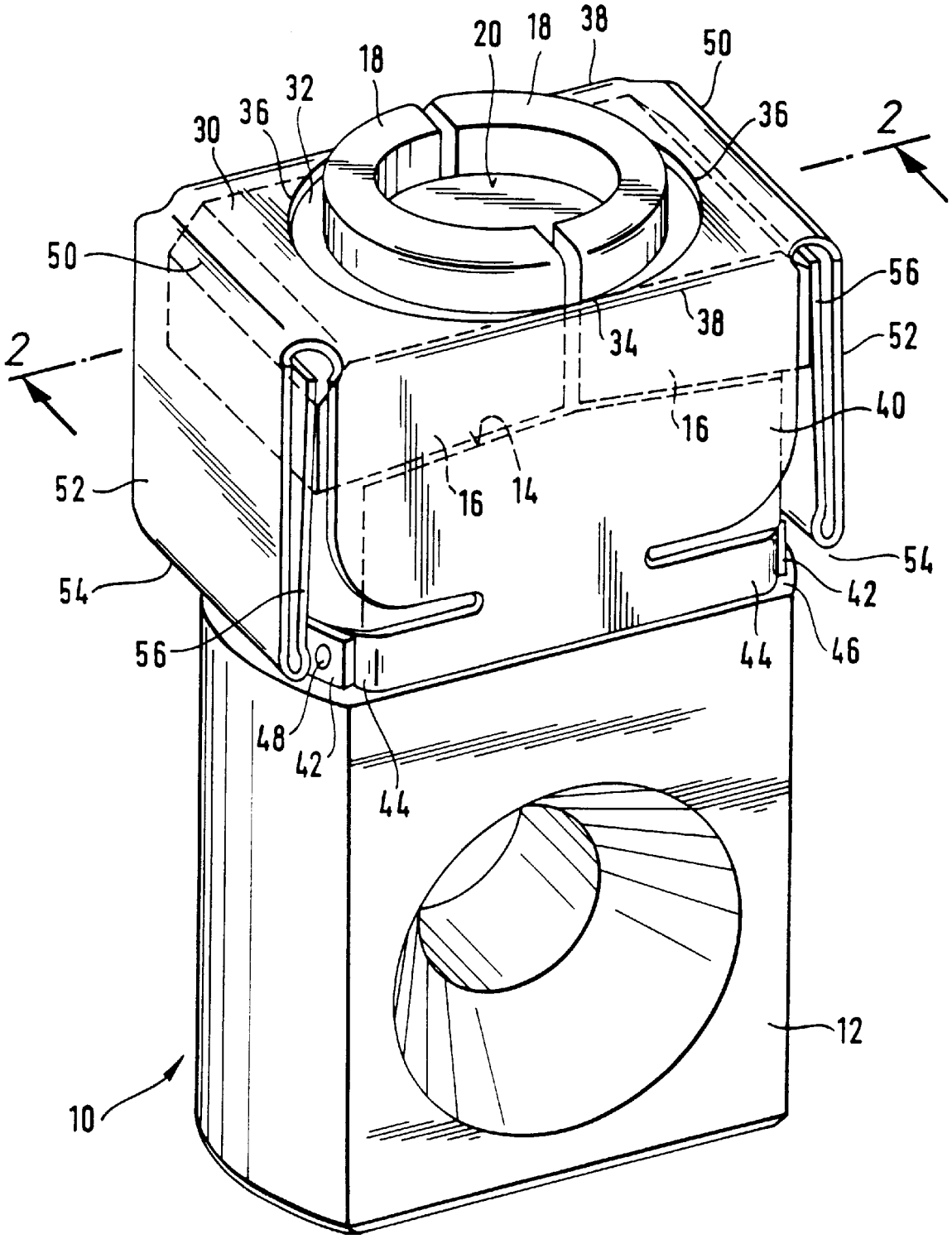
FIG. 1 is an isometric side view of a die according to the invention.
Figure 2:
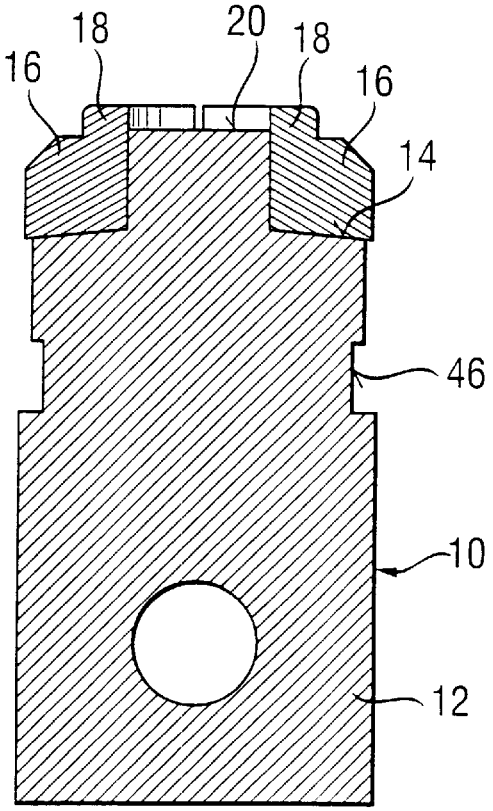
FIG. 2 is a section view of FIG. 1 along line 2—2 through anvil and shaping elements but without assembly elements.
Figure 3:
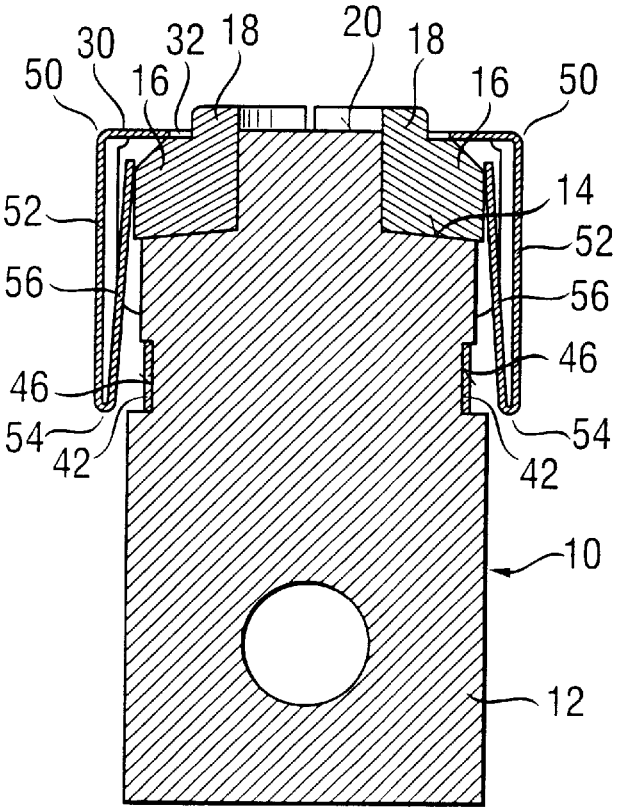
FIG. 3 is a view similar to FIG. 2 but completed by the elements omitted in FIG. 2.

As seen in FIG. 2, the die is quite similar to the die shown in FIG. 1 of the U.S. Pat. No. 4,972,565 mentioned above. It comprises an anvil 10 having a base 12 and roof-like inclined support surfaces 14 on which shaping elements 16 are supported, two being provided in the embodiment shown. The shaping elements have upwards projecting projections 18 which, in plan view, are about crescent-shaped. If material is displaced by means of a punch (here not shown) into the space surrounded by the projections 18 and then is squeezed between the punch and the working surface 20 of the anvil, the material flows laterally, the shaping elements yielding and leaving space for such flowed material. Because of the inclination of the supporting surfaces 14 the yielding motion of the shaping elements includes a downward component. With respect to details, the cited publication is to be referred to, the disclosure of which is included herein by reference.

According to the invention, a single punched-out and bent member is provided to perform the following functions:

securing the shaping elements 16 on anvil 10, guiding the shaping elements 16 parallel to their yielding movement, limiting the outward stroke of the shaping elements, elastically restoring of the shaping elements into their rest position, unreleasably interconnecting all parts forming the die.

The term "unreleasably" means in this context that the die is destroyed upon an attempt to get access to its individual parts.

Figure 4:
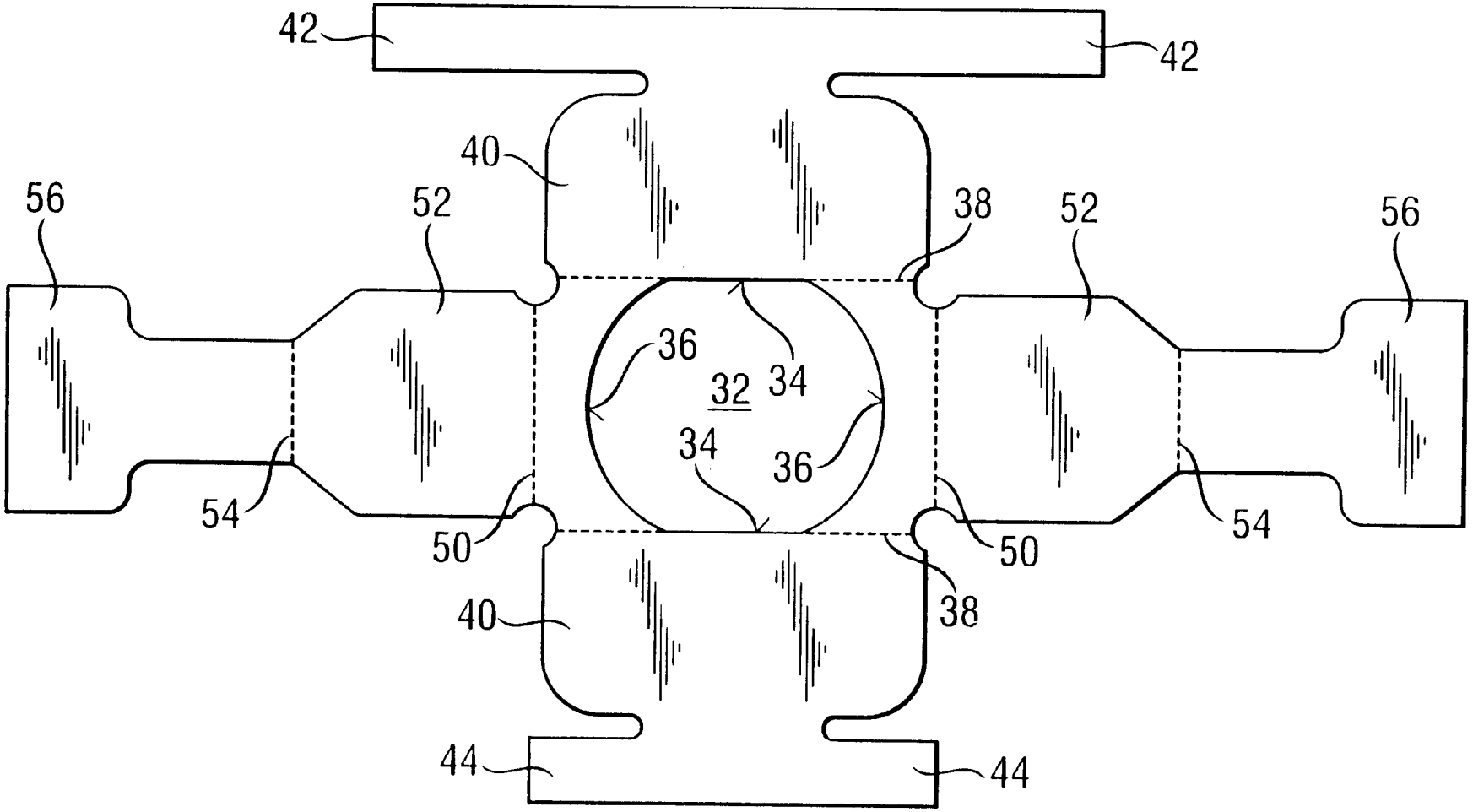
FIG. 4 is a developement of a punched sheet member to be bent into the final shape.
Figure 9:
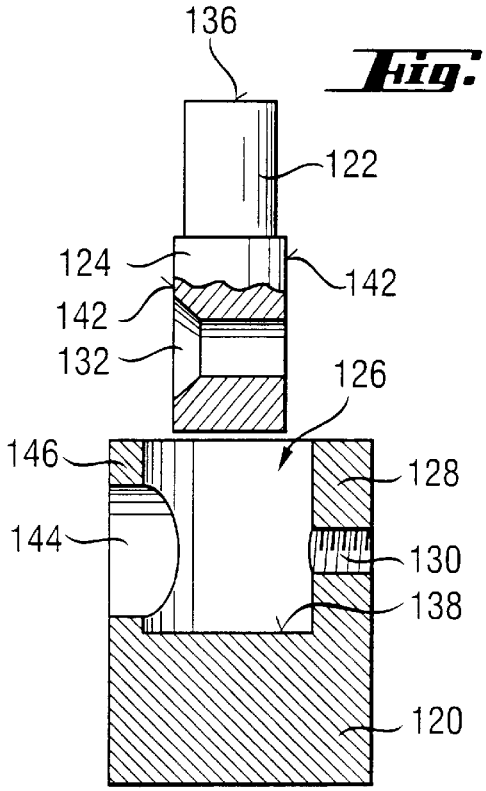
FIGS. 9 through 12 illustrate in analog manner to FIGS. 5 through 8 another type of socket.
Figure 11:
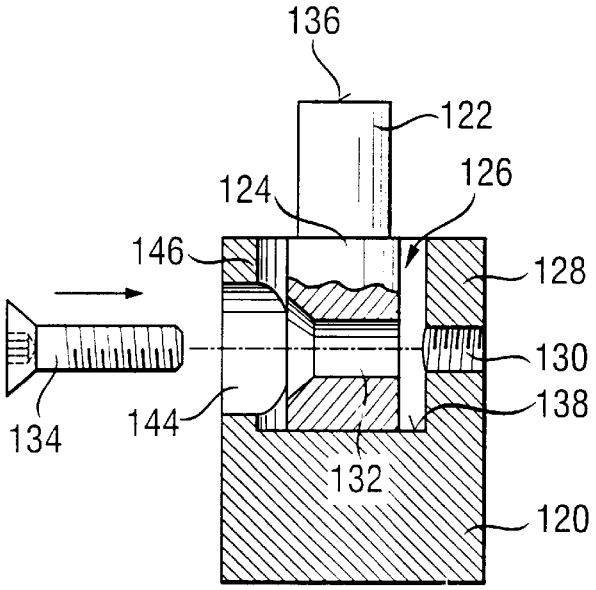
Figure 10:
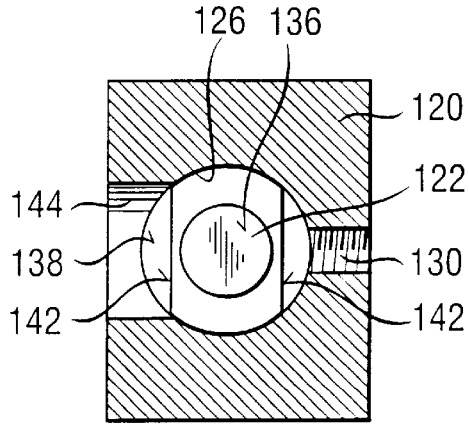
Figure 12:
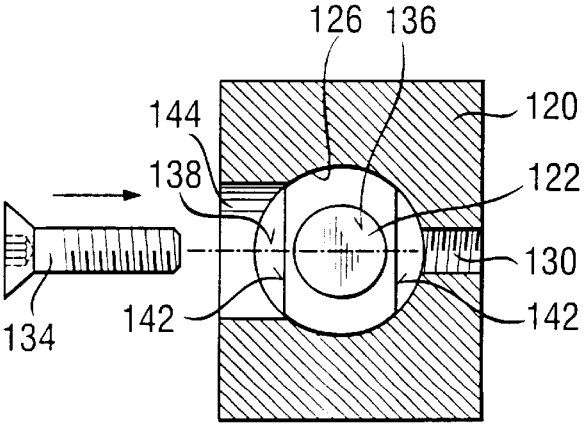

FIG. 4 illustrates the punched-out blank for this member. It comprises a central portion 30 which, upon assembly, is placed on the upper plane surfaces of the shaping elements 16, holding the latter in abutment on supporting surfaces 14 without, however, clamping them. The central portion has an aperture 32 through which, after assembly, projections 18 of shaping elements 16 extend. The aperture has two straight parallel edge sections 34, the ends thereof being interconnected by arc-shaped sections 36. The latter form stops engaged by the projections 18 in abutting relation when the maximum yielding stroke of shaping elements 16 is reached.

The straight edge sections 34 are aligned with first folding lines 38. Lug portions 40 are angled about these folding lines such that they extend perpendicular to the central portion 30 once the member is completed. The term "angle" is to be understood in the context of the invention that not a sharp edge is formed but that a certain curvature is provided; as the member is preferably made of spring steel, the material would break without such bending radius. This applies to all other deformations of the blank, to be described, too.

The function of the lugs formed by the lug portions is alignment and guidance of the shaping elements 16 during their expansion.

One of the lug portions is extended by two long collar portions 42 while the other lug portion is extended by two short collar portions 44. The length of the collar portions is selected such that their total length slightly exceeds the peripheral length of a groove 47 of anvil 10, the groove being provided in a partially cylindrical portion of the anvil. The last step upon assembly consists of bending the collar portions 42 and 44 into this groove and locally interconnecting their overlapping ends, for example by spot welding; these interconnections are located, as may be seen in FIG. 1, slightly inwards with respect to the lugs but readily accessible for interconnection. Of course, each lug could have one long and one short collar portion; the interconnections would then be positioned diametrically opposite to one another.

Two further folding lines 50 extend perpendicular to the first folding lines 38 and connect intermediate portions 52 to central portion 30. two further folding lines 54 extend parallel to the second folding lines, each connecting an intermediate portion to a bias portion 56 finally forming the restoring means. The latter portions are angled, in a first step, about an angle between 90° and 180°, preferably about 170°. In a second step, folding takes place about the four remaining folding lines. The member so completed is placed on the anvil which carries the shaping elements, and fixed as described above. The intermediate portions and the bias portions are dimensioned such that free ends of the latter, after assembly, elastically abut the outer ends of the shaping elements, urging the latter towards one another.

FIGS. 5 through 8 show a socket 120, destined to receive a tool 122 having a shaft 124. Whether the tool is a die or a punch is of no importance; to simplify matters, a punch is indicated. The socket has a square cavity 126 and is provided, in a rear wall 128 of the latter, with a screw-threaded hole 130. Shaft 124 has a through-hole 132 aligned with the screw-thread hole 130, a counter-sunk screw being provided to hold the tool in the cavity. The screw does not transmit press forces; such forces are instead transferred from working end 136 of the punch to the foot 138 of socket 120. As best seen in FIG. 8, shaft 124 has linear contact with lateral walls 140 of socket 120. However, as the rear flattening 142 fully engages the rear wall 128 and the shaft engages foot 138 with its total area, the side walls 140 only laterally position the tool but need not transfer any forces.

The arrows each indicate the direction in which the individual parts are to be displaced upon assembly.

This applies similarly to the design illustrated in FIGS. 9 through 12. In this embodiment, the cavity is hollow-cylindrically shaped. The tool is inserted, with its shaft leading, from the top end of the cavity until its shaft rests on the foot 138 of socket 120. An opening 144 in the cavity front wall 146 permits the penetration of screw 134. Again, the reduced size of contact area between shaft 124 and cavity wall 126 is without risk because only very little forces, if any, are to be transmitted.

It will be seen that in this embodiment, the tool is offset backwards as compared with the embodiment of FIGS. 5 through 8 which may constitute a drawback for some clinching operations, as for example adjacent a bend.

This drawback is overcome in the embodiment of FIGS. 13 through 16. The front wall of the socket is removed to the extent that the flattening of the inserted tool shaft 124 is flush with socket front 148 (cf. FIGS. 17/18). The width of the opening which extends over the full axial length of the shaft is sufficient to permit lateral insertion of the tool, with its partially cylindrical side leading (FIG. 14), into the cavity. The tool is then rotated about 90° (FIGS. 15/16) to bring it into its working position.

At the bottom of the partially cylindrical cavity, there is a step 150 which is engaged by the rear flattening 142 once the tool is rotated into its correct position. It will be seen that shaft 124 is inserted from the front but above step 150 which serves the purpose to prevent rotation of the tool; thereafter, the tool is rotated into proper angular position and then lowered to the foot 138 of the socket 120. Alternatively, at the bottom end of the shaft 124 a groove-shaped recess 152 could be provided adapted to receive step 150; this is indicated in dashed lines in FIGS. 13 and 14. The fixing of the tool in the socket could be done as described above for the embodiment of FIGS. 5 through 8. The frontal access permits a quick tool exchange.

It will be understood that the through-bore 132 of shaft 124 weakens the tool 122. For certain operations, the shaft must transmit very high forces forbidding such weakening. The fixing of the tool in the socket cavity must then be done in another way. Such a solution is illustrated in FIGS. 13 through 20:

Grooves 154 are provided in the partially cylindrical portions of the shaft periphery, for example by means of a lathe. The socket has a screw-threaded hole 130 offset with respect to axis 156 of the shaft such that the conical head 158 of screw 134 engages into one of the grooves thereby securing the tool 122 in socket 120. The dimensions are preferably selected such that the screw head, upon being tightened, exerts a downwardly directed force upon shaft 124 pressing it firmly against foot 138 of socket 120. It is a matter of course that not only one screw hole but two, one for each groove, may be provided.

FIG. 13 through 20 illustrate the grooves 154 with a semicircular section shape. Instead, a triangular section shape could be provided so as to introduce the downward forces in a more uniform manner. The geometry of the screw head need not be concical but should be adapted to the geometry of the groove section shape.

The shaft 124 could have a section shape which is substantially rectangular so as to be adapted to square cavities, but with rounded corner portions adapted to cylindrical cavities.

I claim:

1. A clinching die, comprising an anvil, shaping elements disposed on said anvil and displaceable away from one another, and one single non-elastomeric member mounted on said die for biasing all shaping elements towards one another, wherein a portion of said one single non-elastomeric member forms an unreleasable connection to secure said member to the die.

2. The die of claim 1 wherein said member includes said urging elements and means for limiting a displacement stroke of said shaping elements.

3. The die of claim 1 wherein said member engages over surfaces of said shaping elements opposite to said anvil.

4. The die of claim 3 wherein said member has an aperture, and wherein edges of said aperture overlay said shaping elements.

5. The die of claim 4 wherein said shaping members have abutment portions extending through said aperture, and wherein said aperture edges define abutment stops.

6. The die of claim 1 wherein said member has lugs and said shaping elements are guided by said lugs.

7. The die of claim 1 wherein said member is fixed to said anvil.

8. The die of claim 7 wherein said anvil has a peripheral groove, and wherein said member has a collar engaging into said groove.

9. The die of claim 8 wherein open ends of said collar are interconnected.

10. The die of claim 9 wherein said collar ends are connected by spot welding.

11. The die of claim 9 wherein said member has lugs along which said shaping elements are guided, and wherein said collar has longer ends extending form one lug and shorter end extending from another lug whereby interconnection points of said collar ends are accessible.

12. The die of claim 1 wherein said member is cut from spring steel sheet material and bent into its final shape.

13. The die of claim 2 wherein said urging elements are shaped as leaf spring tongues.

14. A die as in claim 1 wherein said one single non-elastomeric member comprises:

a central portion having an aperture, lug portions connected to said central portion and adapted to be bent therefrom about 90°, collar portions connected to at least one lug portion, intermediate portions connected to said central portion and adapted to be bent therefrom about 90°, urging element portions connected to said intermediate portions and adapted to be bent therefrom about more than 90°.

15. A tool set to be mounted on a press comprising:

a clinching die, comprising an anvil, shaping elements disposed on said anvil and displaceable away from one another, and one sinale non-elastomeric member mounted on said die for biasing all shaping elements towards one another, wherein a portion of said one single non-elastomeric member forms an unreleasable connection to secure said member to the die, a punch cooperating with said anvil of said die to produce clinch connections upon actuation of said press, each of said die and said punch having a shaft to be received within a socket mounted on said press, wherein each shaft is shaped as a cylinder having flattenings on two opposite sides, the cylinder diameter being complementary to the inner diameter of a hollow cylindrical socket cavity, a width of each shaft parallel to said flattenings being complementary to a width of a box-shaped socket cavity, and a distance spacing said flattenings being complementary to a depth of said box-shaped socket cavity.

16. The tool set of claim 15 wherein a recess is provided in a cylindrical shaft periphery.

17. The tool set of claim 16 wherein said recess extends into said flattenings.

18. The tool set of claim 16 wherein said recess is a peripheral groove.

19. The tool set of claim 16 wherein each said shaft has a shoulder in its cylindrical portion.

20. A socket for a tool including a hollow cylindrical cavity and means for preventing rotation of an inserted shaft, said socket adapted to receive said tool selected from the group comprising said die and said punch of claim 15.

21. The socket of claim 20 having an opening in a barrel portion of said cavity.

22. The socket of claim 21 wherein said cavity has an axial length and said opening extending over the entire axial length of said cavity.

23. The socket of claim 20 wherein said opening has a width exceeding a width dimension between said shaft flattenings.

24. The socket of claim 20 wherein said preventing means are provided opposite said opening.

25. The socket of claim 24 wherein said shaft on said tool has a shoulder in its cylindrical portion, said shaft has a recess on a cylindrical shaft periphery, and said preventing means of said socket is complementary to said shoulder.

26. The socket of claim 20 having a screw threaded hole extending along an axis extending orthogonally to an axis of said tool shaft.

27. The socket of claim 26 the screw hole axis being aligned with a shaft recess of said tool.

28. A clinching die, comprising an anvil, shaping elements disposed on said anvil and displaceable away from one another, and one single non-elastomeric member biasing all shaping elements towards one another and mounted on said die such that it is destroyed upon removal, wherein said single non-elastomeric member engages over surfaces of said shaping elements opposite to said anvil and said member has an aperture wherein edges of said aperture overlay said shaping elements, wherein said shaping members have abutment portions extending through said aperture, and wherein said aperture edges define abutment stops.

29. A clinching die, comprising an anvil, shaping elements disposed on said anvil and displaceable away from one another, and one single non-elastomeric member biasing all shaping elements towards one another and mounted on said die such that it is destroyed upon removal, wherein said member has lugs and said shaping elements are guided by said lugs.

30. A clinching die, comprising an anvil, shaping elements disposed on said anvil and displaceable away from one another, and one single non-elastomeric member biasing all shaping elements towards one another and mounted on said anvil such that it is destroyed upon removal, said anvil has a peripheral groove, and wherein said member has a collar engaging into said groove.

31. The die of claim 30 wherein open ends of said collar are interconnected.

32. The die of claim 31 wherein said collar ends are connected by spot welding.

33. The die of claim 31 wherein said member has lugs along which said shaping elements are guided, and wherein said collar has longer ends extending form one lug and shorter end extending from another lug whereby interconnection points of said collar ends are accessible.

34. A blank forming one single non-elastomeric member for use with a die having a groove, said die comprising:

a central portion having an aperture, lug portions connected to said central portion and adapted to be bent therefrom about 90°, collar portions connected to at least one lug portion and adapted to be received in said groove on said die, intermediate portions connected to said central portion and adapted to be bent therefrom about 90°, and urging element portions connected to said intermediate portions and adapted to be bent therefrom about more than 90°.

35. A tool set comprising:

a die comprising an anvil, shaping elements disposed on said anvil and displaceable away from one another, and one single non-elastomeric member biasing all shaping elements towards one another and mounted on said die such that it is destroyed upon removal, and a punch cooperating with said anvil of said die to produce clinch connections upon actuation of said press, said die and said punch each having a shaft adapted to be received within a socket mounted on said press, wherein each shaft is shaped as a cylinder having flattenings on two opposite sides, the cylinder diameter being complementary to the inner diameter of a hollow cylindrical socket cavity, a width of each shaft parallel to said flattenings being complementary to a width of a box-shaped socket cavity, and a distance spacing said flattenings being complementary to a depth of said box-shaped socket cavity.

36. The tool set of claim 35 wherein a recess is provided in a cylindrical shaft periphery.

37. The tool set of claim 36 wherein said recess extends into said flattenings.

38. The tool set of claim 36 wherein said recess is a peripheral groove.

39. The tool set of claim 36 wherein each said shaft has a shoulder in its cylindrical portion.

40. A socket mountable on a press, said socket comprising:

a hollow cylindrical cavity in said socket and means for preventing rotation of an inserted shaft, said cavity adapted to receive a shaft of said tool selected from the group comprising said die and said punch, wherein said shaft is shaped as a cylinder having flattenings on two opposite sides, the cylinder diameter being complementary to the inner diameter of a hollow cylindrical socket cavity, a width of each shaft parallel to said flattenings being complementary to a width of a box-shaped socket cavity, and a distance spacing said flattenings being complementary to a depth of said box-shaped socket cavity.

41. The socket of claim 40 having an opening in a barrel portion of said cavity.

42. The socket of claim 41 wherein said cavity has an axial length and said opening extending over the entire axial length of said cavity.

43. The socket of claim 40 wherein said opening has a width exceeding a width dimension between said shaft flattenings.

44. The socket of claim 40 wherein said preventing means are provided opposite said opening.

45. The socket of claim 44 wherein said shaft of the tool has a recess in a cylindrical shaft periphery, a shoulder in a cylindrical portion of the shaft, and wherein said preventing means is complementary to said shoulder.

46. The socket of claim 40 having a screw threaded hole extending along an axis extending orthogonally to an axis of said tool shaft.

47. The socket of claim 46, the screw hole axis being aligned with a shaft recess of said tool.

* * * * *